US005685133A

United States Patent [19]

Travis

[11] Patent Number: 5,685,133

[45] Date of Patent: Nov. 11, 1997

[54] THERAPEUTIC SADDLE

[76] Inventor: Donald R. Travis, 927 N. Second St., Chillicothe, Ill. 61523

[21] Appl. No.: 328,582

[22] Filed: Oct. 24, 1994

[51] Int. Cl.[6] ..... B28C 1/02; B28C 1/14

[52] U.S. Cl. ..... 54/44.7; 54/44.6; 54/44.1

[58] Field of Search ..... 54/23, 44.1, 44.6, 54/44.7, 46.2

[56] References Cited

U.S. PATENT DOCUMENTS

| | | | |
|---|---|---|---|
| 770,975 | 9/1904 | Lohr | 54/44.6 |
| 2,624,167 | 1/1953 | Diaz | 54/46.1 |
| 3,258,894 | 7/1966 | Hoaglin | 54/44.7 |
| 4,033,097 | 7/1977 | Petit | 54/44.6 |
| 4,570,424 | 2/1986 | Simpson | 54/23 |
| 5,383,327 | 1/1995 | Dohln | 54/44.1 |

FOREIGN PATENT DOCUMENTS

| | | | |
|---|---|---|---|
| 2552065 | 3/1985 | France | 54/44.1 |

*Primary Examiner*—Robert P. Swiatek

*Attorney, Agent, or Firm*—Gardner, Carton & Douglas

[57] ABSTRACT

A therapeutic horse saddle including a seat, a girth for securing the seat to the horse, and a quick release arrangement for normally attaching the girth to the seat but allowing the seat and girth to be quickly removed from the saddle when desired. The girth may be a packing girth. The saddle also includes a cantle cover constructed of plastic laminate attached to the seat. In use, the cover is designed to fit the body shape and to accommodate the physical disability of the rider for whom the saddle was designed. The cantle cover is also resistant to cracking caused by jolts due to movement by the horse or rider. Moreover, the cover is also resistant to expansion or contraction due to thermal changes. The novel saddle also includes an inflatable airbag attached to the cantle cover for supporting the back of the rider. At least two fenders are attached to the saddle seat, and secured to the skirt near the fender's center. At least two elongated rectangular bars are vertically attached to the cantle cover along their elongated sides, and a restraining belt is threaded between the elongated bars and the cantle. In use, the restraining belt crosses the upper abdominal region of the rider thereby helping prevent the rider from falling sideways off the horse. A quick release arrangement permits the restraining belt to be quickly detached from around the rider when desired.

8 Claims, 3 Drawing Sheets

THERAPEUTIC SADDLE

BACKGROUND OF THE INVENTION

1. Field of the Invention

This invention concerns therapeutic horse saddles and more particularly concerns saddles that give comfort, support, protection, and therapeutic benefits to physically disabled riders while providing the highest degree of safety.

2. Description of the Prior Art

Various saddles and saddle accessories have been provided in the prior art to accommodate the special needs of physically disabled riders. Certain of this prior art has included restraining devices that have focused either on safely securing the rider to the saddle or allowing for the rider to be quickly removed from the saddle by sacrificing the complete safety of the rider. The known prior art, however, is bereft of saddles that both safely secure the rider to the saddle and, at the same time, allow the rider to be quickly removed from the horse in case of an emergency. For example, U.S. Pat. No. 5,029,434 to Karen sets forth a saddle riding harness kit having two harness loops and a vest strapped around the rider's torso and that belts to the saddle. A harness loop strapped around each thigh of the rider also straps to the saddle. While this invention attempts to insure that the rider will not fall from the horse, it does not provide a mechanism whereby the rider can be quickly or easily removed from the saddle in case of an emergency.

German Patent No. 193524 to Friedrich describes a harness device attached to the front and back of a saddle that extends over the rider's head and loops under the rider's arms. This device also does not allow the rider to be quickly detached from the saddle in the case of an emergency.

French Patent No. 2,552,065 to Jean-Marie provides for a seat belt device attached to the back end of the saddle. Again, this restraining mechanism does not describe a means for quickly removing the rider from the saddle.

Other restraining devices in the prior art include a vertically extended belt attached to the outside of one side of the cantle that loops around the rider once, extends through a receiver attached to the outside of the other side of the cantle, and loops back around the rider a second time. While this belt also serves to secure the rider to the saddle, it does not provide a means for quickly detaching the rider in the case of an emergency.

U.S. Pat. No. 5,284,005 to Lisa, on the other hand, provides for a restraining device attached to the saddle that does allow for the device to be quickly released from the rider. This result is accomplished, however, through one of two means. The first is the use of either a slip knot, a hook and loop type fastener, or other release cords tying the seat belt to the saddle. The other method is a restraining device that detaches at a defined point along the length of the device by using a hook and loop type fastener, snaps, or releasable glue. While these mechanisms allow for the rider to be quickly released from the saddle, they do not provide a thoroughly safe and secure means for securing the rider to the horse.

The prior art also includes saddles that provide extra comfort to the rider. These saddles, however, are not designed to provide support and protection to the back of the rider. For example, U.S. Pat. No. 4,033,097 sets forth a riding saddle with an inflatable seat, pommel, and cantle. While this device does provide extra cushioning for the rider, it is not designed to support and protect the back of the rider.

Finally, various girths have been provided in the prior art for affixing more securely the saddle to the horse. These girths, however, do not allow the girth to be quickly detached from the horse in the case of an emergency, and they do not offer the additional benefit of translating the horse's motion to the back of the rider so as to stimulate the muscles of the rider and increase the therapeutic benefits. For example, U.S. Pat. No. 4,905,458 sets forth a girth with no slip features that prevent the saddle from rotatably slipping. While the girth does serve to securely attach the saddle to the horse, it does not provide a mechanism for quickly detaching the saddle from the horse in the case of an emergency and does not act to translate the horse's motion to the rider's muscles.

French Patent No. 0 466 270 A1 sets forth a similar girth for securely fastening the saddle to the horse and for quickly detaching the quarters from the saddle. This saddle, however, does not provide for a mechanism for quickly detaching the saddle from the horse in case of an emergency and does not act to translate the horse's motion to the rider's muscles.

Accordingly, a primary object of this invention is to overcome the problems in the prior art described above by providing comfort and support to physically disabled riders and also permitting the rider to be quickly detached from the saddle and permitting the saddle to be quickly detached from the horse when desired.

A further object of this invention is to translate the motion of the horse to the body of the physically disabled rider thereby stimulating the rider's muscles and increasing the therapeutic benefits.

Other objects and advantages of the invention will become apparent upon reading the following detailed description and upon reference to the drawings. Throughout the drawings, like reference numerals refer to like parts.

SUMMARY OF THE INVENTION

The present invention relates to a therapeutic horse saddle. The saddle includes a seat, a girth for securing the seat to the horse, and a quick release means for normally attaching the girth to the seat but allowing the seat and girth to be quickly removed from the saddle when desired. The girth may be a packing girth. The saddle also includes a cantle cover constructed of plastic laminate attached to the seat. In use, the cover is designed to fit the body shape and to accommodate the physical disability of the rider for whom the saddle was designed. The cantle cover is also resistant to cracking caused by jolts due to movement by the horse or rider. Moreover, the cover is resistant to expansion or contraction due to thermal changes. The novel saddle also includes an inflatable means attached to the cantle cover for supporting the back of the rider. At least two fenders are attached to the saddle seat, and a securing means secures the fenders to the skirt near the center of the fenders. At least two elongated rectangular bars are vertically attached to the cantle cover along their elongated sides, and a restraining belt is threaded between the elongated bars and the cantle. In use, the restraining belt crosses the upper abdominal region of the rider thereby helping prevent the rider from falling sideways off the horse. A quick release means permits the restraining belt to be quickly detached from around the rider when desired.

DETAILED DESCRIPTION OF PREFERRED EMBODIMENTS

While the invention will be described in connection with a preferred embodiment, it will be understood that it is not intended to limit the invention to this embodiment. On the contrary, it is intended to cover all alternatives, modifications and equivalents as may be included within the spirit and scope of the invention.

Figure 2:
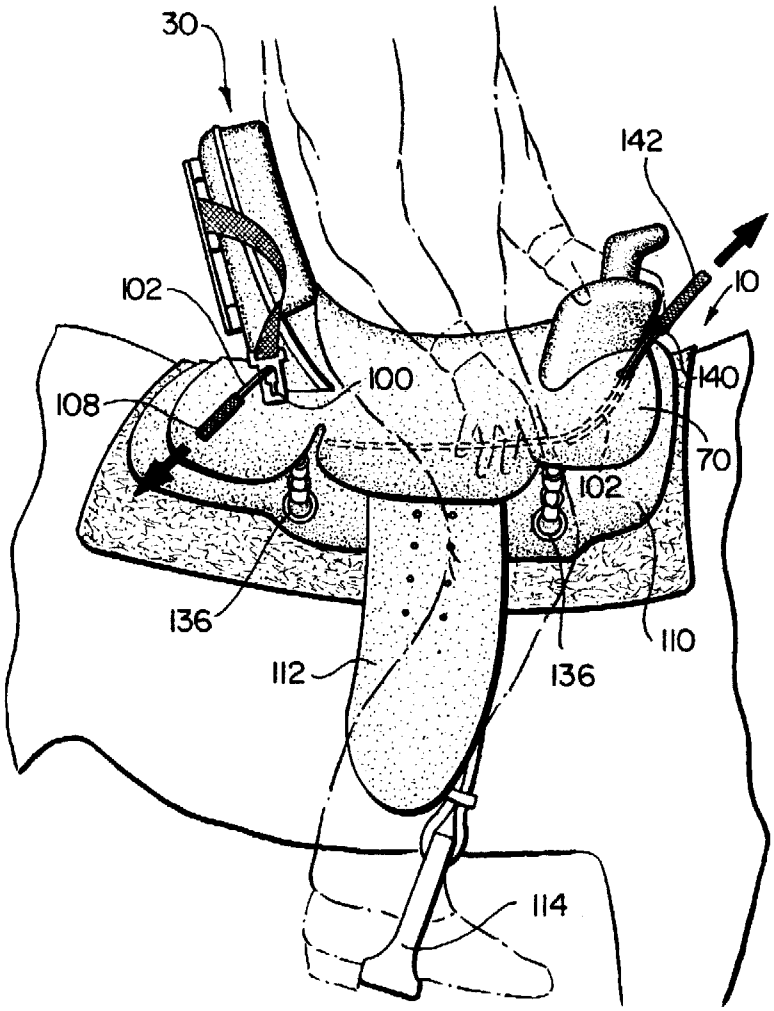
FIG. 2 is a side elevational view similar to FIG. 1 but showing the belt hanging loose. No girth is shown.
Figure 1:
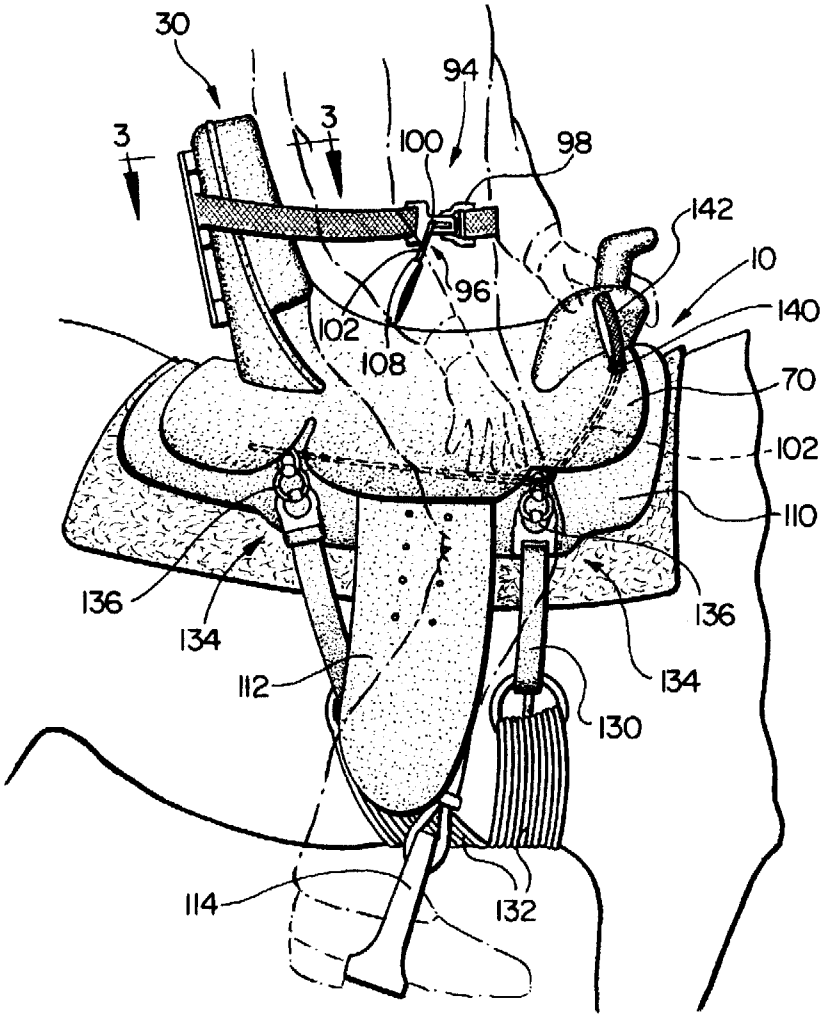
FIG. 1 is a side elevational view showing one embodiment of the saddle as it appears on a horse with a rider belted on to the saddle and the girth belted around the horse's belly.
Figure 3:
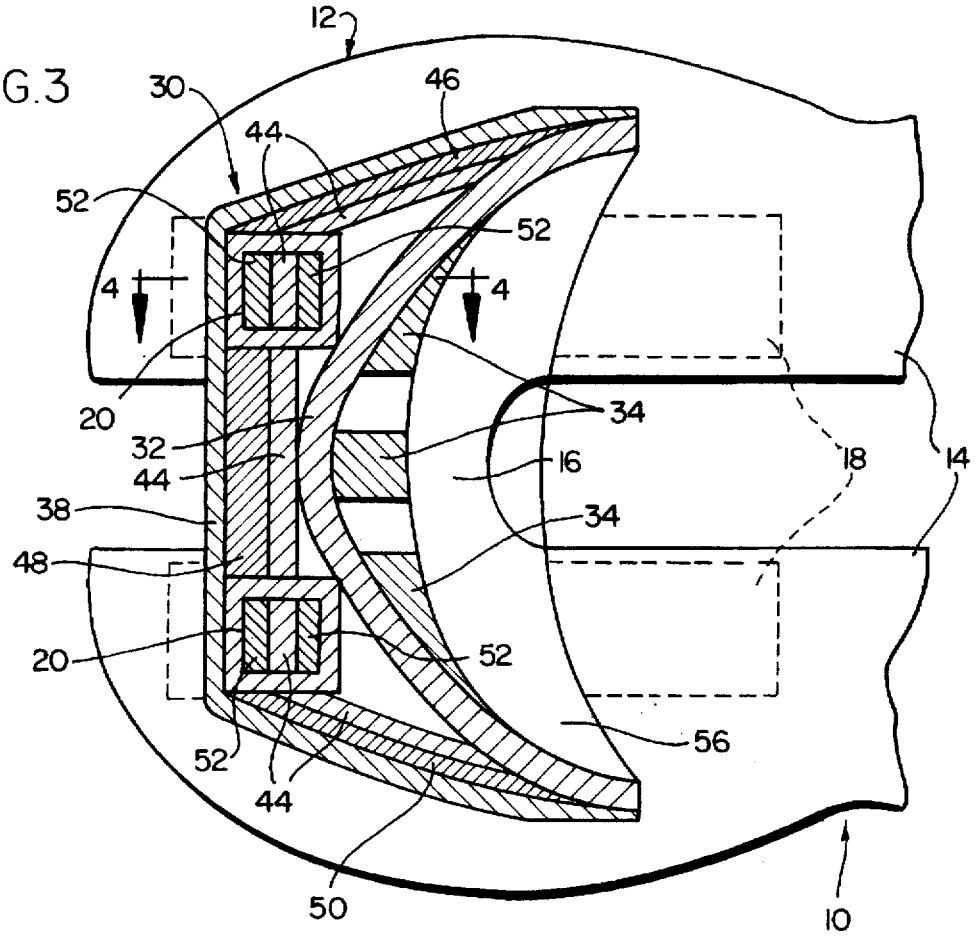
FIG. 3 is a cross-sectional view of an outer cantle cover taken substantially in the plane of line 3—3 in FIG. 1 and showing a saddle tree, metal plates, and metal tubes.

Turning initially to FIGS. 1–3, a therapeutic saddle 10 includes a tree 12 comprising two horizontal bars 14 that extend along the left and right sides of the horse. A wooden cantle 16 is attached to the top of the two horizontal bars 14 at the back end of the tree 12. A suitable tree is manufactured by Superior Saddle Tree Co. of Grand Junction, Colo.

To provide strength and durability to the cantle, metal plates 18 are joined by their flat sides to the bottoms of the horizontal bars 14 one third of the way down the horizontal bars 14, centered directly underneath the cantle 16. The metal plates are preferably made of steel or aluminum. Suitable steel and aluminum is sold by Drum White of East Peoria, Ill. The dimensions of the metal plates of the embodiments shown in FIG. 3 are approximately 2 feet by 3 inches.

Figure 4:
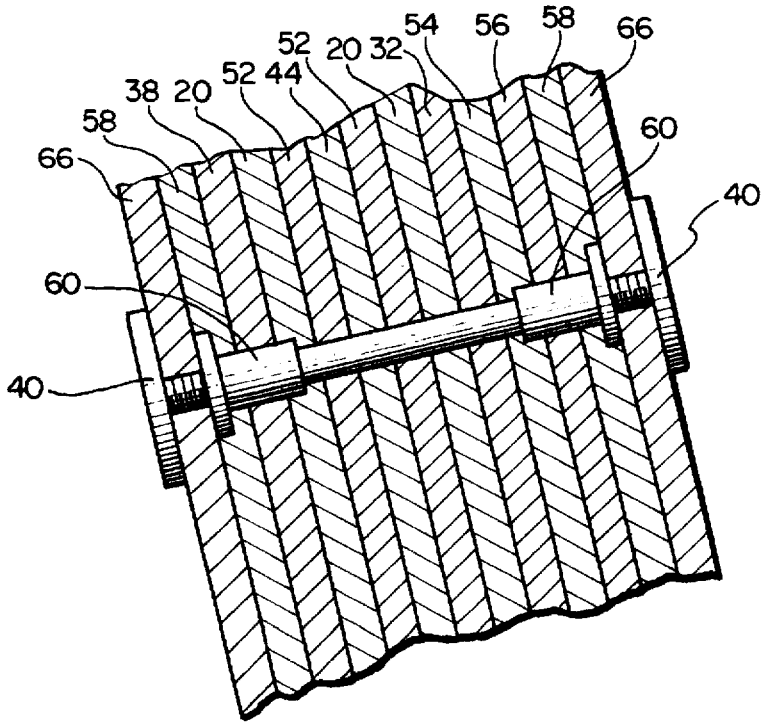
FIG. 4 is a fragmented cross-sectional view of an outer cantle cover taken substantially in the plane of line 4—4 in FIG. 3.

Metal tubes 20 affixed to the tops of the metal plates 18 rise vertically through the tops of the horizontal bars 14 at an angle behind the cantle 16. The angle is determined by the body shape of the rider for whom the saddle is being constructed and by the particular physical handicap of the anticipated rider. The angle helps the hips of the anticipated rider roll to their proper position such that the rider's spine is provided the most comfort and protection possible. A typical angle is 80° from horizontal. The metal tubes 20 are square and preferably made out of either steel or aluminum. Suitable steel and aluminum is sold by Drum White of East Peoria, Ill. The metal tubes of the embodiments shown in FIGS. 3–4 are approximately 1 inch square in cross-section.

An outer cantle cover 30 is constructed to attach over both the cantle 16 and the metal tubes 20 to the top of the tree 12. The outer cantle cover 30 is designed to fit the size, weight and posture of the rider for whom the therapeutic saddle 10 is designed to provide the most comfort and support possible. The outer cantle cover 30 is made of plastic which is resistant to cracks caused by jolts due to the movement of the horse or rider and is resistant to expansion or contraction due to thermal changes. A suitable polyethylene plastic is sold by Cope Plastics of Peoria, Ill.

To resist cracking and breaking caused by jolts due to movement of the horse or the rider and thus provide an advantage over using one single piece of molded plastic, the outer cantle cover 30 comprises first a center piece 32 that attaches between the cantle 16 and the metal tubes 20. As shown in FIGS. 3–4, this center piece 32 is constructed of plastic that has been heated and molded to fit in between the cantle 16 and the metal tubes 20. In between the cantle 16 and the center piece 32, front spacers 34 are attached. These front spacers 34 are constructed of thin, rectangular strips of plastic, placed on top of one another, and then welded together with plastic welding. The welded pieces are then sanded down or otherwise shaped to fit closely between the cantle 16 and the center piece 32. The front spacers 34 are then welded by known plastic welding procedures to the center piece 32. In the illustrated embodiment, the thickness of the individual rectangular strips of plastic comprising the laminate is about ¼ of an inch.

To take up space between the center piece 32 and a cantle back 38 so that bolts 40 do not buckle in or dent the plastic, a back spacer 44 is attached to the top of the tree 12 behind the center piece 32. The back spacer 44 is made of a single sheet of plastic with four long notches cut into it to create two long rectangular strips of plastic that correspond to the thickness of the metal tubes 20 such that the strips fit closely within the metal tubes 20. The back spacer is then molded to fit the shape of the center piece 32 and welded to the back of the center piece 32 by known plastic welding procedures.

Extra spacers 46, 48 and 50 are fitted to the back of the back spacer 44 and the center piece 32 on top of the tree 12. Extra spacer 46 starts along the outside left edge of the metal tube 20 on the left side of the tree 12 and extends to a point close to the end of the left side of the center piece 32. Extra spacer 48 extends between the two metal tubes 20 over the gap between the two horizontal bars 14. Extra spacer 50 begins along the outer right edge of the metal tube 20 on the right side of the tree base 12 and extends to a point close to the end of the right side of the center piece 32. Plastic welding is used to attach the extra spacers 46, 48 and 50 to the center piece 32 and the back spacer 44. The back side of the metal tubes 20, the back sides of the extra spacers 46, 48, and 50, and the ends of the back side of the center piece 32 form a continuous curvilinear plane. More extra spacers 52 fill up the gaps between the metal tubes 20 and the portions of the back spacer 38 fitted within the metal tubes 20.

All of the extra spacers are constructed of thin, rectangular strips of plastic placed on top of one another and then welded together like the front spacers 34. The welded pieces are sanded down or otherwise shaped to fit closely either along the outside of the center piece 32 and the back spacer 44 in the case of the extra spacers 46, 48 and 50, or between the metal tubes 20 and the back spacer 38 in the case of the extra spacers 52.

The cantle back 38 is attached to the outside of the curvilinear plane described above on top of the tree 12. The cantle back 38 is made of a single sheet of plastic molded to fit the curvilinear plane. The cantle back 38 is plastic welded to the extra spacers 46, 48 and 50, and the ends of the center piece 32 along the curvilinear plane.

A cantle front 56 is attached on top of the cantle 16 and back at an angle across the front spacers 34 and the center piece 32. The cantle front 56 is constructed out of thin, rectangular strips of plastic placed on top of one another and then welded together with plastic welding like the front spacers 34 and the extra spacers 46, 48, 50 and 52. The cantle front 56 is sanded or otherwise shaped to fit across the front spacers 34 and the center piece 32 and welded with plastic center piece spacers 34 and the center piece 32.

As shown in FIGS. 1–2 and 4, the entire outer cantle cover 30 and tree 12 is covered with rawhide 58 to provide strength to the entire assembly and to hold the outer cantle cover 30 together if any of the plastic welds break. Threaded inserts 60 are placed through the outer cantle cover 30 at the front and back to provide further strength. A leather covering 66 is then placed around the outside of the rawhide 58. Finally, the bolts 40 extend through the entire thickness of the outer cantle cover 30, including the leather covering 66, the threaded inserts 60, the rawhide 58, the cantle front 56, the front spacers 34, the center piece 32, the metal tubes 20, the extra spacers 52, the back spacer 44, and the cantle back 38.

Turning now to FIGS. 1–2, pursuant to the invention, a seat 70 is attached on top of the tree 12. In the preferred embodiment the seat is made of a chemical type jell that comes preformed in a flexible plastic bag-like container. A suitable seat is sold by WRS Sports Med of Waco, Tex. Preferably, the seat is only approximately ⅝ of an inch thick, thinner than the normal 2 to 2¾ inch thick saddle seat. In accordance with this aspect of the invention, a thinner seat allows more of the horse's motion to be translated to the body of the rider, thereby stimulating the rider's muscles and increasing the therapeutic benefits.

Figure 7:
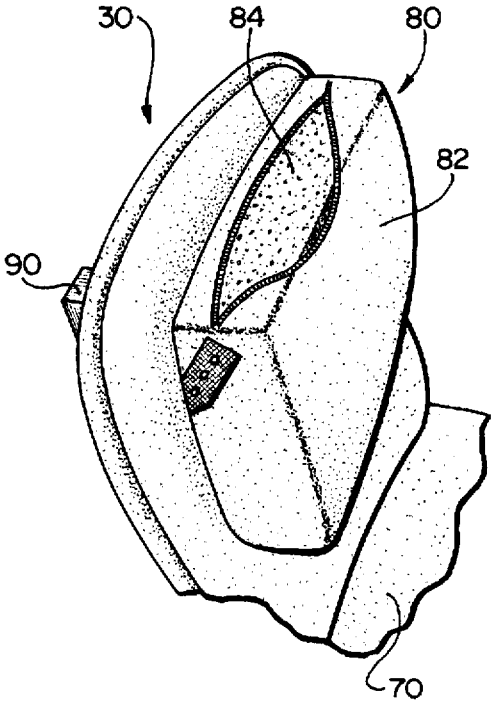
FIG. 7 is an isometric illustration of an outer cantle cover and an airbag placed inside an airbag cover attached to the outer cantle cover.

As illustrated in FIG. 7, an inflatable means 80 for supporting the back of the rider is attached to the front of the outer cantle cover 30 above the seat 70. In the preferred embodiment the inflatable means 80 comprises an airbag cover 82 attached to the outer cantle cover 30 by the bolts 40 and an airbag 84 that fits within the airbag cover 82. The airbag 84 is preferably a single rectangular bag with a self-inflating valve that fits through a hole in the airbag cover 82. The airbag 84 acts to protect the back of the rider and the paraplegic rider's exterior spinal support rods. The airbag 84, working in conjunction with the outer cantle cover 30, gives a specialized fit to the rider thereby providing better safety, posture, and comfort. The outer cantle cover 30 is further designed so that the airbag system 80 is specifically placed to cushion the back of the rider for whom the therapeutic saddle 10 was designed thereby reducing shock to both the anticipated rider's back, the tree 12, the metal plates 18, and the metal tubes 20. As an alternative embodiment, the therapeutic saddle 10 may include multiple airbag covers 82 and airbags 84, each airbag 84 being independently inflatable.

Figure 6:
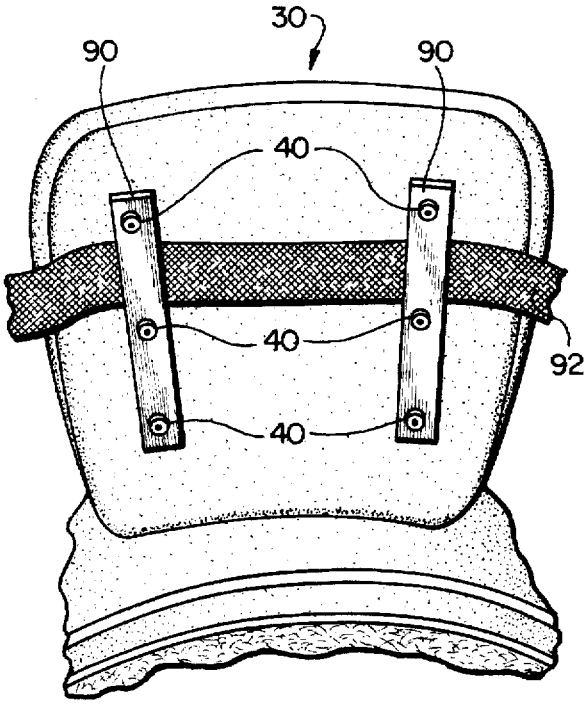
FIG. 6 is an isometric illustration of the back of an outer cantle cover showing elongated rectangular bars bolted to the back of the outer cantle cover and a restraining belt threaded through the bars and the cover.

In FIG. 6, two vertically elongated rectangular bars 90 are shown attached to the back of the outer cantle cover 30 along their elongated sides by the bolts 40. The elongated bars 90 are preferably made of wood. Threaded between the elongated bars 90 and the outer cantle 30 is a restraining belt 92. The restraining belt 92 is preferably a long piece of nylon that may be cinched tight to prevent the rider from falling from the horse. In the illustrated embodiment, the restraining belt 92 may be threaded between any of the bolts 40 thereby permitting the height of the restraining belt 92 along the outer cantle 30 to be varied to accommodate various riders. This arrangement allows the restraining belt 92 to extend across the upper abdominal region of the rider which helps prevent the rider from falling sideways off the horse.

Turning now to FIG. 1–2, attached to the restraining belt 92 is a quick release means 94 for permitting the restraining belt to be quickly detached from around the rider when desired. In the preferred embodiment of the invention, the quick release means is a quick release parachute mechanism 96 designed both to ensure that the rider is firmly attached to the therapeutic saddle 10 and to allow the rider to be quickly released from the saddle in case of an emergency.

The parachute mechanism 96 comprises first a V-shaped parachute buckle 98 threaded through one end of the restraining belt 92. The V-shaped parachute buckle 98 is preferably made of cadmium plated steel and tensile tested to a strength of 2500 pounds. A suitable V-shaped buckle is sold by Para-Gear Equipment Co., Inc. of Skokie, Ill.

At the opposite end is connected a parachute clasp 100 that firmly engages the V-shaped parachute buckle 98. The parachute clasp 100 is preferably made of cadmium plated steel and is tensile tested to 2500 pounds. A suitable parachute clasp is sold by Para-Gear Equipment Co., Inc. of Skokie, Ill.

In the illustrated embodiment, the restraining belt 92 is pulled across the upper abdominal region of the rider. The parachute clasp 100 is clasped around the V-shaped parachute buckle 98 and the restraining belt 92 is tightened across the rider's upper abdominal region by pulling tight the end of the restraining belt 92 threaded through the V-shaped parachute buckle 98.

A quick release cord 102 is attached to the parachute buckle 98. The quick release cord 102 is preferably made of woven steel covered with a plastic sheath. The thickness of the quick release cord of the embodiments shown in FIGS. 1–2 is approximately ⅛ of an inch. When the quick release cord 102 is pulled, the parachute clasp 100 immediately unclasps from around the V-shaped parachute buckle 98 while simultaneously pushing out the V-shaped parachute buckle 98 from the parachute clasp 100. The rider is thus quickly released from the saddle while the ends of the restraining belt 92 are positively pushed away from each other thereby reducing the risk that the restraining belt 92 will become entangled with the rider. In the illustrated embodiment, a cord handle 108 is attached to the quick release cord 102 providing a larger surface area to pull.

Pursuant to the invention, a skirt 110 is attached around the circumference of the therapeutic saddle 10 underneath the lip of the tree 12. Fenders 112 are attached to both the center left and center right sides of the skirt 110 so that the top end of each fender 112 is placed under the seat 70. Stirrups 114 to hold the rider's feet hang down from the lower end of the fenders 112.

Figure 5:
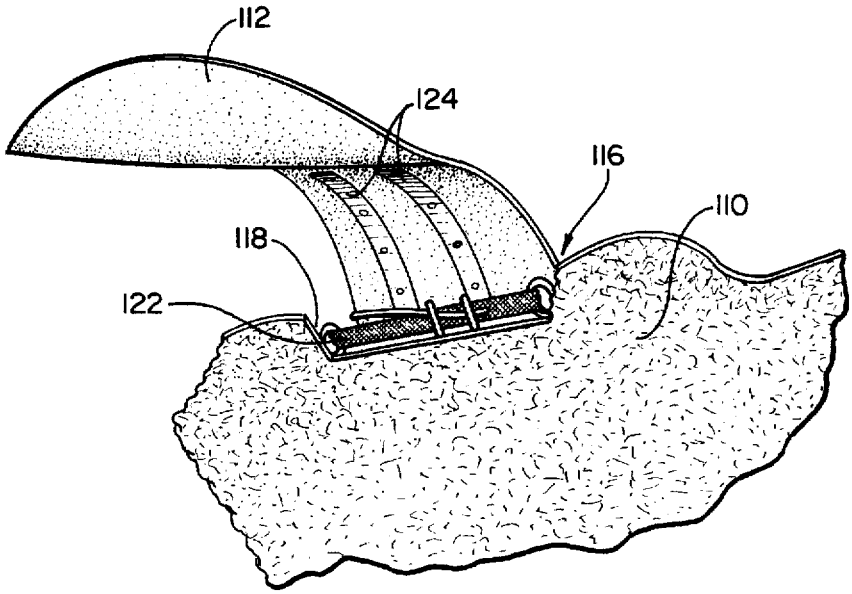
FIG. 5 is an isometric illustration of the underside of a saddle skirt showing a fender belted to the skirt through straps attached to the fender.

Turning now to FIG. 5, a securing means 116 secures the fenders 112 near their centers to the skirt 110. The securing means 116 helps prevent the legs of a paraplegic or quadriplegic rider from swinging free and catching in, or bumping against, stationary objects. By tying down the fenders, the rider's legs are held steady within the stirrups 114 next to the fenders 112, obviating the need to tie the rider's legs together or to attach the rider's legs to the saddle.

In the preferred embodiment, the securing means 116 includes two rectangular notches in the skirt 110. One rectangular notch 118 is formed in the bottom center of the left side of the skirt 110 and another rectangular notch 120 (not shown) is formed in the bottom center of the right side of the skirt 110. Belts 122 are attached within the rectangular notches, each running from one end of the vertical sides of a rectangular notch to the other vertical side of that rectangular notch. Two elongated straps 124 are attached to each of the fenders 112 along their vertical axes so that one of the belts 122 may be belted to the elongated straps 124 on one fender 112 thereby holding that fender 112 near its center.

As shown in FIG. 1, a girth 130 is attached to one side of the skirt 110 and the tree 12, runs underneath the horse, and is attached to the other side of the skirt 110 and the tree 12. The girth is preferably a packing girth that includes two straps 132 as shown in FIG. 1. The packing girth provides one more strap than a regular riding girth to secure the saddle more tightly to the horse thereby providing extra safety, reducing abrasion to the horse's back by reducing movement of the saddle, and reducing the risk that the horse might buck. The packing girth also translates more of the horse's motion to the back of the rider so as to stimulate the rider's muscles and increase the therapeutic benefits, in furtherance of the invention.

As shown in FIGS. 1–2, the girth 130 is attached to the skirt 110 by a quick release means 134 that permits the girth 130 and therapeutic saddle 10 to be quickly removed from the saddle when desired. This quick release means 134 is an additional safety feature providing another method for freeing the rider from the horse in case of an emergency.

In the preferred embodiment, the quick release means 134 includes quick release parachute riggings 136 attached to the skirt 110. If a packing girth is used, as shown in FIG. 1, then two quick release parachute riggings 136 should be attached to the front and back of the left side of the skirt 110, one for each strap 132, and two quick release parachute riggings 136 should be attached to the front and back of the right side of the skirt 110, again one for each strap 132. If a normal riding girth is used, then one quick release parachute rigging 136 should be attached to each side of the skirt 110. The ends of the girth 130 are attached to the quick release parachute riggings 136. Preferably, the quick release parachute riggings 136 are made out of cadmium plated steel. A suitable quick release parachute rigging is sold by Para-Gear Equipment Co. of Skokie, Ill.

Quick release cords 102 are used to release the ends of the girth 130 from the quick release parachute riggings 136. In the preferred embodiment, one quick release cord 102 begins approximately two or three inches behind the quick release parachute rigging 136 at the back of one side of the therapeutic saddle 10. The quick release cord 102 is then strung through the quick release parachute rigging 136, underneath the skirt 110, and out the front of the therapeutic saddle 10. The quick release cord 102 is then extended back down through the front of the therapeutic saddle 10 forming a small loop 140 that sticks out of the therapeutic saddle 10. The remainder of the quick release cord 102 is then strung back underneath the skirt 110 and through the quick release parachute rigging 136 at the front of that side of the therapeutic saddle 10. The quick release cord 102 ends approximately two or three inches behind the front quick release parachute rigging 136. The other quick release cord 102 is similarly configured on the other side of the therapeutic saddle 10. If a normal single strap rigging is used, then the quick release cord is strung through the single quick release parachute rigging 136 on that side of the skirt 110 and out of the front of the therapeutic saddle 10.

If a packing girth is used, the girth 130 is released from the quick release parachute riggings 136 on one side of the therapeutic saddle 10 by pulling the loop 140 formed in the quick release cord 102 so that both ends of the quick release cord 102 are pulled out of the quick release parachute riggings 136. If a normal riding girth is used, the girth 130 is released from the quick release parachute rigging 136 on one side of the therapeutic saddle 10 by pulling the end of the quick release cord 102 that extends from the front of the therapeutic saddle 10 so that the other end of the quick release cord 102 is pulled out of the quick release parachute rigging 136. The girth 130 is then released from the quick release parachute rigging or riggings 136 on that side of the horse thereby releasing the therapeutic saddle 10 from the horse.

If a packing girth is used, the location of the loop 140 will depend on the extent of the physical handicap of the anticipated rider. If the rider has use of his hands, then the loop 140 will be located so that the rider may reach it. If the rider does not have use of his hands, then the loop 140 will be located so that it can be easily reached by attendants. If a normal riding girth is used, the location of the end of the quick release cord 102 that extends through the front of the therapeutic saddle 10 will also depend on the same factors. A handle 142 can be attached to the loop 140 or to the end of the quick release cord 102 providing a large surface area to pull.

It can be appreciated from the foregoing description that the present invention provides a therapeutic horse saddle that gives comfort and support to physically disabled riders. Further, the novel therapeutic horse saddle provides the maximum protection to the rider by normally firmly securing the rider to the saddle, but permitting the rider to be quickly removed from the saddle and the saddle to be quickly removed from the horse in case of an emergency.

I claim:

1. A therapeutic saddle for providing comfort, support and safety to physically disabled riders, comprising, in combination: a seat having a top and underside, the saddle further including a tree base attached to the seat underside and comprising at least two horizontal bars laid parallel to fit along the left and right side of the horse; and a cantle formed of plastic laminate welded together and attached to the seat top, the cantle being resistant to cracking caused by jolts due to movement by the horse or rider and being resistant to expansion or contraction due to thermal changes, the cantle being attached perpendicularly to the top of the horizontal bars.

2. The therapeutic saddle of claim 1, further including at least two supporting metal plates attached to the left and right sides of the therapeutic saddle and extending underneath the bars of the tree base.

3. The therapeutic saddle of claim 2, further including at least two metal support tubes attached substantially vertically to the supporting metal plates and rising behind the cantle at an angle.

4. The therapeutic saddle of claim 3, further including an outer cantle made of plastic laminate and attached over the top of both the cantle and the metal support tubes.

5. A therapeutic saddle for providing comfort, support and safety to physically disabled riders, comprising, in combination: a seat having a top and underside; a skirt attached to the seat underside, the skirt defining at least two rectangular notches, one formed in the bottom center of the left side of the skirt and one formed in the bottom center of the right side of the skirt; at least two fenders attached to the seat; and a securing means for securing the fenders to the skirt near the center of the fenders thereby reducing the fenders' oscillatory motion, the securing means including at least two belts, each belt running from one vertical side of one of the rectangular notches to the other side of said rectangular notch.

6. The therapeutic saddle of claim 5, wherein each fender has at least one elongated strap attached lengthwise to the back side of said fender along its vertical axis.

7. A therapeutic saddle for providing comfort, support and safety to physically disabled riders, comprising, in combination: a seat having a top and underside; a cantle attached to the top of the seat; at least two elongated rectangular bars attached to the cantle and extending vertically along the cantle elongated sides; and a restraining belt threaded between the elongated rectangular bars and the cantle such that the restraining belt extends across the upper abdominal region of the rider thereby helping prevent the rider from falling sideways off the horse.

8. The therapeutic saddle of claim 7, further including at least one quick release parachute buckle threaded through the restraining belt so as to permit the restraining belt to be quickly detached from around the rider when desired.

* * * * *